US008698851B2

(12) United States Patent
Moon et al.

(10) Patent No.: US 8,698,851 B2
(45) Date of Patent: Apr. 15, 2014

(54) METHOD OF DRIVING DISPLAY PANEL AND DISPLAY APPARATUS FOR PERFORMING THE SAME

(75) Inventors: Hoi-Sik Moon, Asan-si (KR); Duc-Han Cho, Incheon (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 232 days.

(21) Appl. No.: 13/016,224

(22) Filed: Jan. 28, 2011

(65) Prior Publication Data

US 2012/0026206 A1 Feb. 2, 2012

(30) Foreign Application Priority Data

Jul. 30, 2010 (KR) ..... 2010-0073930

(51) Int. Cl.
*G09G 5/10* (2006.01)

(52) U.S. Cl.
USPC ..... 345/690; 345/691; 345/692

(58) Field of Classification Search
None
See application file for complete search history.

(56) References Cited

U.S. PATENT DOCUMENTS

| | | | | |
|---|---|---|---|---|
| 6,552,706 | B1 * | 4/2003 | Ikeda et al. | 345/96 |
| 2007/0046607 | A1 * | 3/2007 | Lai | 345/92 |
| 2007/0182685 | A1 * | 8/2007 | Park et al. | 345/96 |
| 2009/0002301 | A1 * | 1/2009 | Koo et al. | 345/89 |
| 2009/0109247 | A1 * | 4/2009 | Kimura | 345/690 |
| 2011/0012887 | A1 * | 1/2011 | Lee et al. | 345/212 |

* cited by examiner

*Primary Examiner* — Alexander Eisen
*Assistant Examiner* — Nan-Ying Yang
(74) *Attorney, Agent, or Firm* — F. Chau & Associates, LLC

(57) ABSTRACT

A display apparatus includes a first pixel including a first pixel electrode connected to first data and gate lines, a second pixel including a second pixel electrode connected to a second data and gate lines, a third pixel including a third pixel electrode connected to a third data line and the first gate line, a fourth pixel including a fourth pixel electrode connected to a fourth data line and the second gate line, a fifth pixel including a fifth pixel electrode connected to a fifth data line and the second gate line, a sixth pixel including a sixth pixel electrode connected to a sixth data line and the first gate line, a seventh pixel including a seventh pixel electrode connected to a seventh data line and the second gate line, and an eighth pixel including an eighth pixel electrode connected to an eighth data line and the first gate line.

20 Claims, 5 Drawing Sheets

METHOD OF DRIVING DISPLAY PANEL AND DISPLAY APPARATUS FOR PERFORMING THE SAME

CROSS-REFERENCE TO RELATED APPLICATION

This application claims priority under 35 U.S.C. §119 to Korean Patent Application No. 2010-0073930, filed on Jul. 30, 2010, the disclosure of which is incorporated by reference herein in its entirety.

BACKGROUND

1. Technical Field

Exemplary embodiments of the present invention relate to a method of driving a display panel and a display apparatus for performing the method. More particularly, exemplary embodiments of the present invention relate to a method of driving a display panel for improving display quality and a display apparatus for performing the method.

2. Discussion of the Related Art

Generally, a liquid crystal display (LCD) apparatus includes an LCD panel, a data driver, and a gate driver. The LCD panel may include an array substrate, a color filter substrate, and a liquid crystal layer. The array substrate may include a plurality of data lines, a plurality of gate lines, a plurality of switching elements, and a plurality of pixel electrodes. For example, the array substrate may include I×J switching elements electrically connected to I data lines and J gate lines, and I×J pixel electrodes electrically connected to the switching elements. I and J are natural numbers. The color filter substrate may include a plurality of color filters and a common electrode. The LCD panel is driven by way of the data driver providing data voltages to the I data lines, and the gate driver providing gate signals to the J gate lines.

Increasing the frame rate of the LCD panel when driving the LCD panel may improve image distortion such as, for example, a motion blur effect. However, as a result of the high frame rate, the time required to charge a data voltage to a pixel is relatively decreased. Similarly, the time required to recover from distortion of the data voltage applied to the pixel electrode, and distortion of a common voltage applied to the common electrode is decreased. This results in image distortion such as, for example, a greenish effect occurring when a vertical stripe pattern is displayed on the LCD panel, non-uniform luminance distribution, or cross talk.

SUMMARY OF THE INVENTION

Exemplary embodiments of the present invention provide a method of driving a display panel capable of preventing image distortion.

Exemplary embodiments of the present invention also provide a display apparatus for performing the above-mentioned method.

According to an exemplary embodiment of the present invention, a display apparatus includes a first pixel, a second pixel, a third pixel, a fourth pixel, a fifth pixel, a sixth pixel, a seventh pixel and an eighth pixel. The first pixel includes a first pixel electrode electrically connected to the first data line and a first gate line through a first switching element. The second pixel includes a second pixel electrode electrically connected to the second data line and a second gate line through a second switching element. The third pixel includes a third pixel electrode electrically connected to the third data line and the first gate line through a third switching element.

The second and third data lines are adjacent to each other and disposed between the first and third pixels. The fourth pixel includes a fourth pixel electrode electrically connected to the fourth data line and the second gate line through a fourth switching element. The fifth pixel includes a fifth pixel electrode electrically connected to the fifth data line and the second gate line through a fifth switching element. The fourth and fifth data lines are adjacent to each other and disposed between the fourth and fifth pixels The sixth pixel includes a sixth pixel electrode electrically connected to the sixth data line and the first gate line through a sixth switching element. The seventh pixel includes a seventh pixel electrode electrically connected to the seventh data line and the second gate line through a seventh switching element. The sixth and seventh data lines are adjacent to each other and disposed between the fifth and seventh pixels. The eighth pixel includes an eighth pixel electrode electrically connected to the eighth data line and the first gate line through an eighth switching element.

According to an exemplary embodiment of the present invention, a method of driving a display panel includes applying data voltages to a first, second, third, fourth, fifth, sixth, seventh, and eighth data line of the display panel, and applying the same gate signal to first and second gate lines of the display panel. The display panel includes a first pixel, a second pixel, a third pixel, a fourth pixel, a fifth pixel, a sixth pixel, a seventh pixel and an eighth pixel. The first pixel includes a first pixel electrode electrically connected to the first data line and a first gate line through a first switching element. The second pixel includes a second pixel electrode electrically connected to the second data line and a second gate line through a second switching element. The third pixel includes a third pixel electrode electrically connected to the third data line and the first gate line through a third switching element. The second and third data lines are adjacent to each other and disposed between the first and third pixels. The fourth pixel includes a fourth pixel electrode electrically connected to the fourth data line and the second gate line through a fourth switching element. The fifth pixel includes a fifth pixel electrode electrically connected to the fifth data line and the second gate line through a fifth switching element. The fourth and fifth data lines are adjacent to each other and disposed between the fourth and fifth pixels The sixth pixel includes a sixth pixel electrode electrically connected to the sixth data line and the first gate line through a sixth switching element. The seventh pixel includes a seventh pixel electrode electrically connected to the seventh data line and the second gate line through a seventh switching element. The sixth and seventh data lines are adjacent to each other and disposed between the fifth and seventh pixels. The eighth pixel includes an eighth pixel electrode electrically connected to the eighth data line and the first gate line through an eighth switching element.

According to an exemplary embodiment of the present invention, a method of driving a display panel includes applying a gate signal to first and second adjacent pixel rows simultaneously, applying two voltages having opposite polarities to two adjacent data lines, and inverting the polarities of the two applied voltages during consecutive frames. A first pixel in the first adjacent pixel row and a first pixel in the second adjacent pixel row are charged with data voltages having opposite polarities, and a second pixel in the first adjacent pixel row and a second pixel in the second adjacent pixel row are charged with data voltages having opposite polarities. The two adjacent data lines are disposed between two adjacent pixels.

According to an exemplary embodiment of pixel structures of the present invention, distortion of a common voltage may be decreased during polarity inversion driving, resulting in the uniform distribution of luminance and reduced cross talk.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF EXEMPLARY EMBODIMENTS

Figure 1:
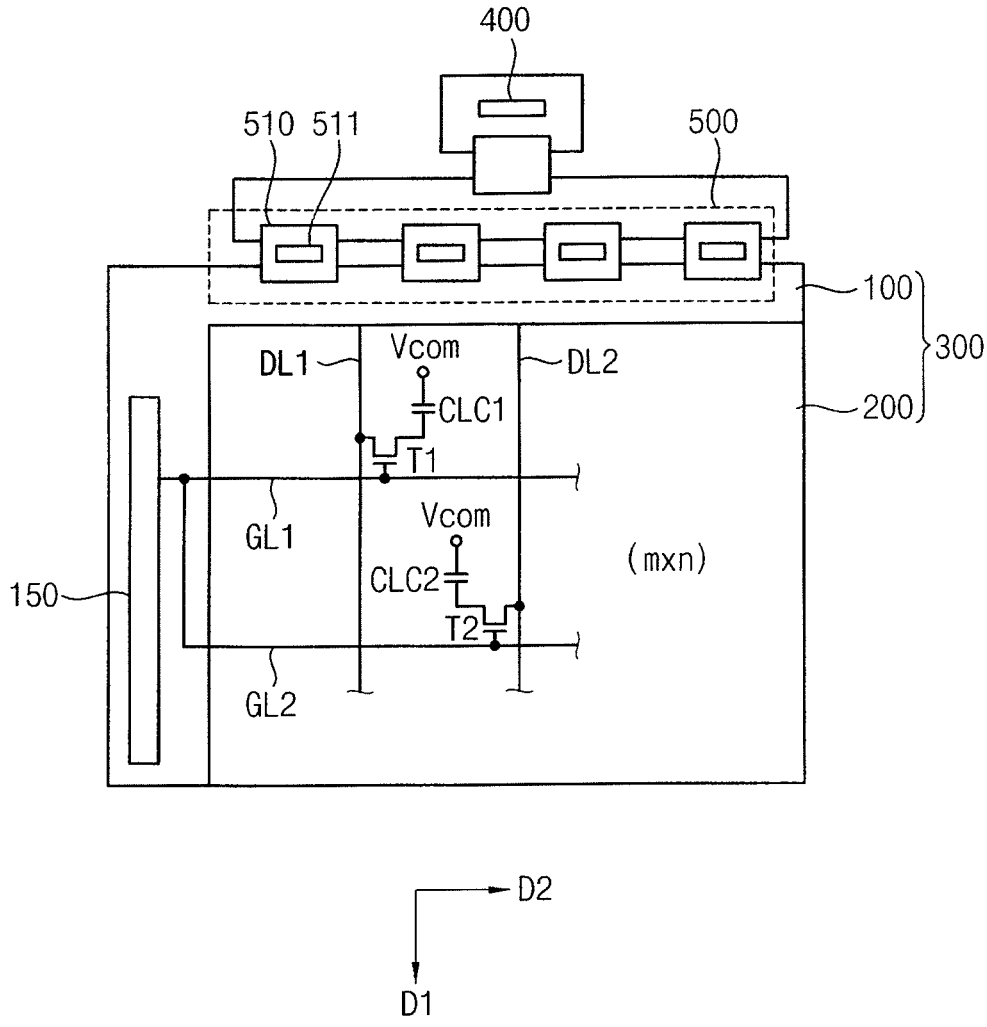
FIG. 1 is a plan view of a display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Like reference numerals refer to like elements throughout the accompanying drawings.

FIG. 1 is a plan view of a display apparatus according to an exemplary embodiment of the present invention.

Referring to FIG. 1, the display apparatus includes a display panel 300, a timing controller 400, and a data driver 500.

The display panel 300 includes a first substrate 100, a second substrate 200 opposing the first substrate 100, and a liquid crystal layer disposed between the first and second substrates 100 and 200.

The first substrate 100 includes a display area and a peripheral area surrounding the display area. A plurality of data lines, a plurality of gate lines crossing the data lines, and a plurality of pixel electrodes are disposed in the display area. The data lines DL1 and DL2 are extended in a first direction D1 and arranged in a second direction D2 crossing the first direction D1. The gate lines GL1 and GL2 are extended in the second direction D2 and arranged in the first direction D1. The pixel electrodes are disposed in a plurality of pixel areas defined on the first substrate 100. For example, the pixel areas may be arranged in a matrix form. A plurality of color filters may be disposed in the pixel areas.

The data driver 500 and a gate driver 150 are disposed in the peripheral area of the first substrate 100. The data driver 500 is disposed in a portion of the peripheral area corresponding to end portions of the data lines DL1 and DL2, and the gate driver 150 is disposed in a portion of the peripheral area corresponding to end portions of the gate lines GL1 and GL2. The gate driver 150 may include a thin film transistor (hereinafter referred to as a "switching element") disposed in the display area, or a plurality of switching elements disposed in the display area. The gate driver 150 may be directly mounted in the peripheral area of the first substrate 100. Alternatively, the gate driver 150 may be formed as a flexible printed circuit board (not shown) on which a gate driving chip (not shown) is mounted. Similarly, the data driver 500 may be directly mounted in the peripheral area of the first substrate, or formed as a flexible printed circuit board 510 on which a data driving chip 511 is mounted.

The second substrate 200 opposes the first substrate 100. The second substrate 200 includes a common electrode facing the pixel electrodes disposed on the first substrate 100. The second substrate 200 may further include a plurality of color filters.

The display panel 300 may include a plurality of pixels defined by the first substrate 100, the second substrate 200, and the liquid crystal layer. The pixels are disposed in a matrix form having a plurality of pixel rows and a plurality of pixel columns. The pixels may include red, green, and blue pixels. The pixels may be defined using unit pixels including red, green, and blue pixels. For example, when a resolution of the display panel 300 is m×n, the number of the pixels may be m×n×3, the number of data lines may be m×3×2, and the number of gate lines may be n. m and n are natural numbers. In an exemplary embodiment, the display panel may further include a unit pixel including at least one of yellow, cyan, magenta, or white pixels in addition to the red, green, and blue pixels.

For example, a first pixel P1 includes a first switching element T1 electrically connected to a first data line DL1 and a first gate line GL1, and a first liquid crystal capacitor CLC1 electrically connected to the first switching element T1. The first liquid crystal capacitor CLC1 is defined by a first pixel electrode disposed on the first substrate 100, a common electrode disposed on the second substrate 200, and the liquid crystal layer. A common voltage Vcom is provided to the common electrode, and a data voltage having a first polarity with respect to the common voltage Vcom is provided to the first pixel electrode through the first data line DL1. The second pixel P2 is disposed adjacent to the first pixel P1 in the first direction D1. The second pixel P2 includes a second switching element T2 electrically connected to a second data line DL2 and a second gate line GL2, and a second liquid crystal capacitor CLC2 electrically connected to the second switching element T2. The second liquid crystal capacitor CLC2 is defined by a second pixel electrode disposed on the first substrate 100, the common electrode disposed on the second substrate 200, and the liquid crystal layer. The common voltage Vcom is provided to the common electrode, and a data voltage having a second polarity with respect to the common voltage Vcom is provided to the second pixel electrode through the second data line DL2.

The timing controller 400 controls operations of the gate driver 150 and the data driver 500.

The gate driver 150 generates gate signals corresponding to half of the number of the gate lines (e.g., n/2), and sequentially outputs the gate signals in response to the timing controller 400. For example, the gate driver 150 generates a first gate signal, and provides the first gate signal to the first gate line GL1 and the second gate line GL2, which may be electrically connected to each other. Alternatively, when the first gate line GL1 and the second gate line GL2 are not connected to each other, the gate driver 150 may separately provide the first gate signal to the first gate line GL1 and the second gate line GL2 simultaneously.

The data driver 500 provides data signals to the pixels disposed in two pixel rows during a horizontal cycle 1H, in response to the timing controller 400. The data driver 500 provides data signals having opposite polarities to adjacent data lines. For example, the data driver 500 provides a first data signal having a first polarity with respect to the common voltage Vcom to the first data line DL1, and a second data signal having a second, opposite polarity to the second data line DL2. The data driver 500 may invert the polarities of the data signals in every frame when providing the data signals to the data lines.

Figure 2:
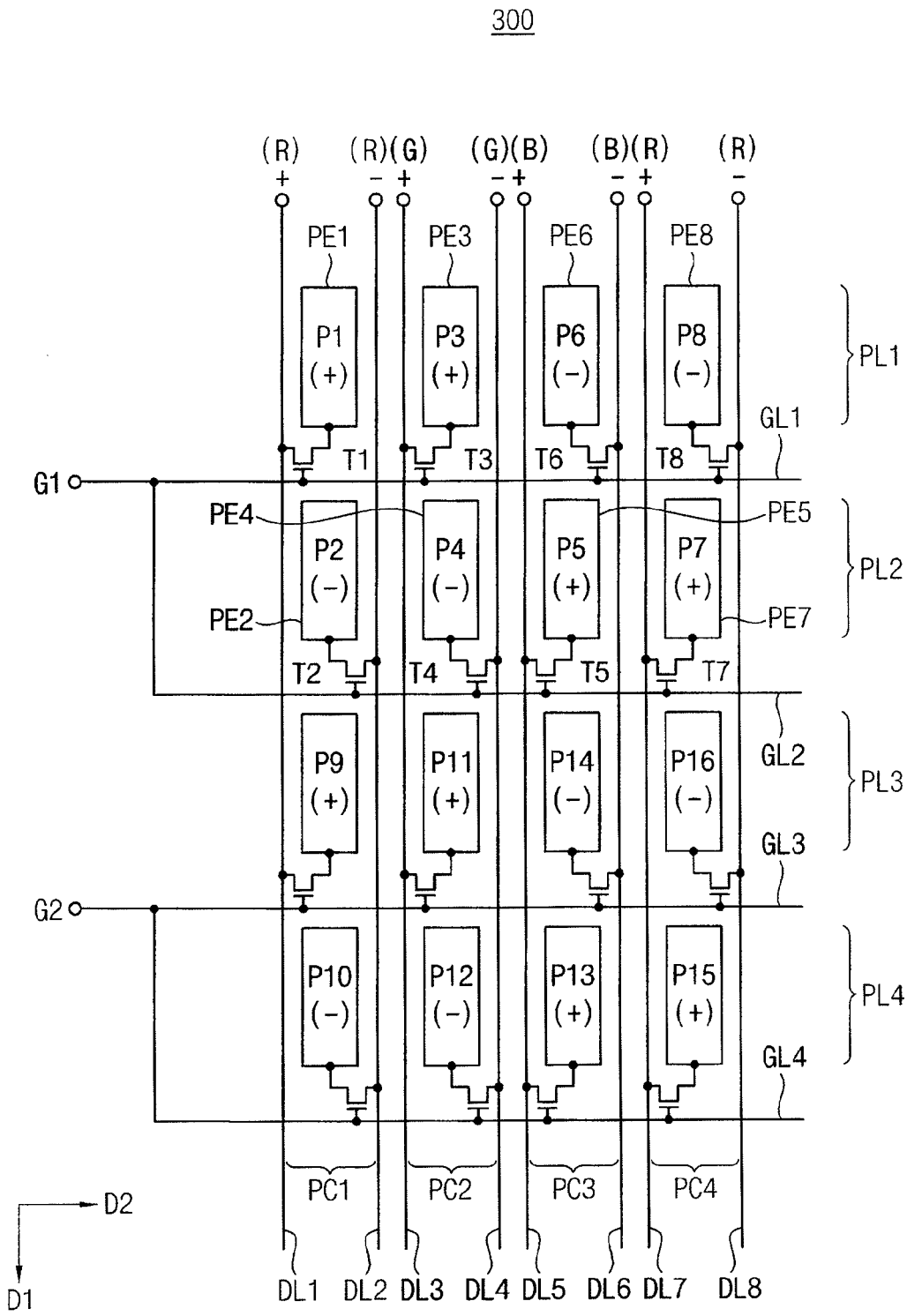
FIG. 2 is a diagram of the display panel of FIG. 1 according to an exemplary embodiment of the present invention.

FIG. 2 is a diagram illustrating the display panel of FIG. 1 according to an exemplary embodiment of the present invention.

Referring to FIG. 2, the display panel 300 includes a plurality of data lines DL1, DL2, DL3, . . . , DL8, a plurality of gate lines GL1, GL2, GL3 and GL4, and a plurality of pixels P1, P2, P3, . . . , P16.

A first pixel P1 includes a first switching element T1 electrically connected to a first data line DL1 and a first gate line GL1, and a first pixel electrode PE1 electrically connected to the first switching element T1. A data signal having a first polarity (+) with respect to a common voltage Vcom is applied to the first data line DL1 at a K-th frame. K is a natural number. A first liquid crystal capacitor of the first pixel P1 may be defined by the first pixel electrode PE1, a common electrode (not shown) opposite the first pixel electrode PE1, and a liquid crystal layer disposed between the first pixel electrode PE1 and the common electrode.

A second pixel P2 is disposed adjacent to the first pixel P1 in the first direction D1. The second pixel P2 includes a second switching element T2 electrically connected to a second data line DL2 and a second gate line GL2, and a second pixel electrode PE2 electrically connected to the second switching element T2. The second gate line GL2 is electrically connected to the first gate line GL1. A data signal having a second polarity (−) with respect to the common voltage Vcom is applied to the second data line DL2 at the K-th frame. The second pixel P2 may include a second liquid crystal capacitor.

A third pixel P3 is disposed adjacent to the first pixel P1 in the second direction D2. The third pixel P3 includes a third switching element T3 electrically connected to a third data line DL3 adjacent to the second data line DL2 and connected to the first gate line GL1, and a third pixel electrode PE3 electrically connected to the third switching element T3. A data signal having the first polarity (+) with respect to the common voltage Vcom is applied to the third data line DL3 at the K-th frame. The third pixel P3 may include a third liquid crystal capacitor.

A fourth pixel P4 is disposed adjacent to the third pixel P3 in the first direction D1. The fourth pixel P4 includes a fourth switching element T4 electrically connected to a fourth data line DL4 and the second gate line GL2, and a fourth pixel electrode PE4 electrically connected to the fourth switching element T4. A data signal having the second polarity (−) with respect to the common voltage Vcom is applied to the fourth data line DL4 at the K-th frame. The fourth pixel P4 may include a fourth liquid crystal capacitor.

A fifth pixel P5 is disposed adjacent to the fourth pixel P4 in the second direction D2. The fifth pixel P5 includes a fifth switching element T5 electrically connected to a fifth data line DL5 adjacent to the fourth data line DL4 and connected to the second gate line GL2, and a fifth pixel electrode PE5 electrically connected to the fifth switching element T5. A data signal having the first polarity (+) with respect to the common voltage Vcom is applied to the fifth data line DL5 at the K-th frame. The fifth pixel P5 may include a fifth liquid crystal capacitor.

A sixth pixel P6 is disposed adjacent to the third pixel P3 in the second direction D2. The sixth pixel P6 includes a sixth switching element T6 electrically connected to a sixth data line DL6 and the first gate line GL1, and a sixth pixel electrode PE6 electrically connected to the sixth switching element T6. A data signal having the second polarity (−) with respect to the common voltage Vcom is applied to the sixth data line DL6 at the K-th frame. The sixth pixel P6 may include a sixth liquid crystal capacitor.

A seventh pixel P7 is disposed adjacent to the fifth pixel P5 in the second direction D2. The seventh pixel P7 includes a seventh switching element T7 electrically connected to a seventh data line DL7 and the second gate line GL2, and a seventh pixel electrode PE7 electrically connected to the seventh switching element T7. A data signal having the first polarity (+) with respect to the common voltage Vcom is applied to the seventh data line DL7 at the K-th frame. The seventh pixel P7 may include a seventh liquid crystal capacitor.

An eighth pixel P8 is disposed adjacent to the sixth pixel P6 in the second direction D2. The eighth pixel P8 includes an eighth switching element T8 electrically connected to an eighth data line DL8 and the first gate line GL1, and an eighth pixel electrode PE8 electrically connected to the eighth switching element T8. A data signal having the second polarity (−) with respect to the common voltage Vcom is applied to the eighth data line DL8 at the K-th frame. The eighth pixel P8 may include an eighth liquid crystal capacitor.

Ninth to sixteenth pixels P9, P10, P11, . . . , P16 are repeatedly disposed in a substantially similar manner as the pixel structures of the first to eighth pixels P1, P2, P3, . . . , P8. A plurality of the pixels of the display panel 300 are repeatedly disposed using a unit pixel structure including the pixel structures of the first to eighth pixels P1, P2, P3, . . . , P8.

The first, third, sixth and eighth pixels P1, P3, P6 and P8 are disposed in a first pixel row PL1. The second, fourth, fifth and seventh pixels P2, P4, P5 and P7 are disposed in a second pixel row PL2. The ninth, eleventh, fourteenth and sixteenth pixels P9, P11, P14 and P16 are disposed in a third pixel row PL3. The tenth, twelfth, thirteenth and fifteenth pixels P10, P12, P13 and P15 are disposed in a fourth pixel row PL4. The first, second, ninth and tenth pixels P1, P2, P9 and P10 are disposed in a first pixel column PC1. The third, fourth, eleventh and twelfth pixels P3, P4, P11 and P12 are disposed in a second pixel column PC2. The sixth, fifth, fourteenth and thirteenth pixels P6, P5, P14 and P13 are disposed in a third pixel column PC3. The eighth, seventh, sixteenth and fifteenth pixels P8, P7, P16 and P15 are disposed in a fourth pixel column PC4. The pixels in the first and fourth pixel columns PC1 and PC4 may be red pixels, the pixels in the second pixel column PC2 may be green pixels, and the pixels in the third pixel column PC3 may be blue pixels.

The pixels P1, P2, P9 and P10 disposed in the first pixel column PC1 are electrically connected to the first and second data lines DL1 and DL2. The pixels P3, P4, P11 and P12 disposed in the second pixel column PC2 are electrically connected to the third and fourth data lines DL3 and DL4. The pixels P6, P5, P14 and P13 disposed in the third pixel column PC3 are electrically connected to the fifth and sixth data lines DL5 and DL6. The pixels P8, P7, P16 and P15 disposed in the fourth pixel column PC4 are electrically connected to the seventh and eighth data lines DL7 and DL8.

In addition, the pixels P1, P3, P6 and P8 disposed in the first pixel row PL1 and the pixels P2, P4, P5 and P7 disposed in the second pixel row PL2 are electrically connected to the first and second gate lines GL1 and GL2, which are electrically connected to each other. The pixels P9, P11, P14 and P16 disposed in the third pixel row PL3 and the pixels P10, P12, P13 and P15 disposed in the fourth pixel row PL4 are electrically connected to the third and fourth gate lines GL3 and GL4, which are electrically connected to each other.

When a first gate signal G1 is applied to the first and second gate lines GL1 and GL2, the liquid crystal capacitors of pixels P1, P3, P6 and P8 in the first pixel column PL1, and the liquid crystal capacitors of pixels P2, P4, P5 and P7 in the second pixel column PL2 are charged to the data voltages of the data signals provided to the first to eighth data lines DL1, DL2, DL3, . . . , DL8. Similarly, when a second gate signal G2 is applied to the third and fourth gate lines GL3 and GL4, the liquid crystal capacitors of pixels P9, P11, P14 and P16 in the third pixel column PL3, and the liquid crystal capacitors of pixels P10, P12, P13 and P15 in the fourth pixel column PL4 are charged to the data voltages of the data signals provided to the first to eighth data lines DL1, DL2, DL3, . . . , DL8.

As shown in FIG. 2, the pixels in the first pixel row PL1 of the display panel 300 are driven by 2-dot inversion. The pixels in the second pixel row PL2, which are driven simultaneously with the pixels in the first pixel row PL1, are inversely driven with respect to the pixels in the first pixel row PL1. For example, when the display panel 300 is driven by 2×1 dot inversion, a (2+1) test pattern is displayed on the display panel 300, and image distortion may be prevented. In addition, data voltages having opposite polarities are applied to two data lines disposed between two adjacent pixel columns, resulting in a decrease in a coupling for a frame inversion during a vertical blanking period. As a result, image distortion such as, for example, a horizontal line defect may be prevented.

Figure 3:
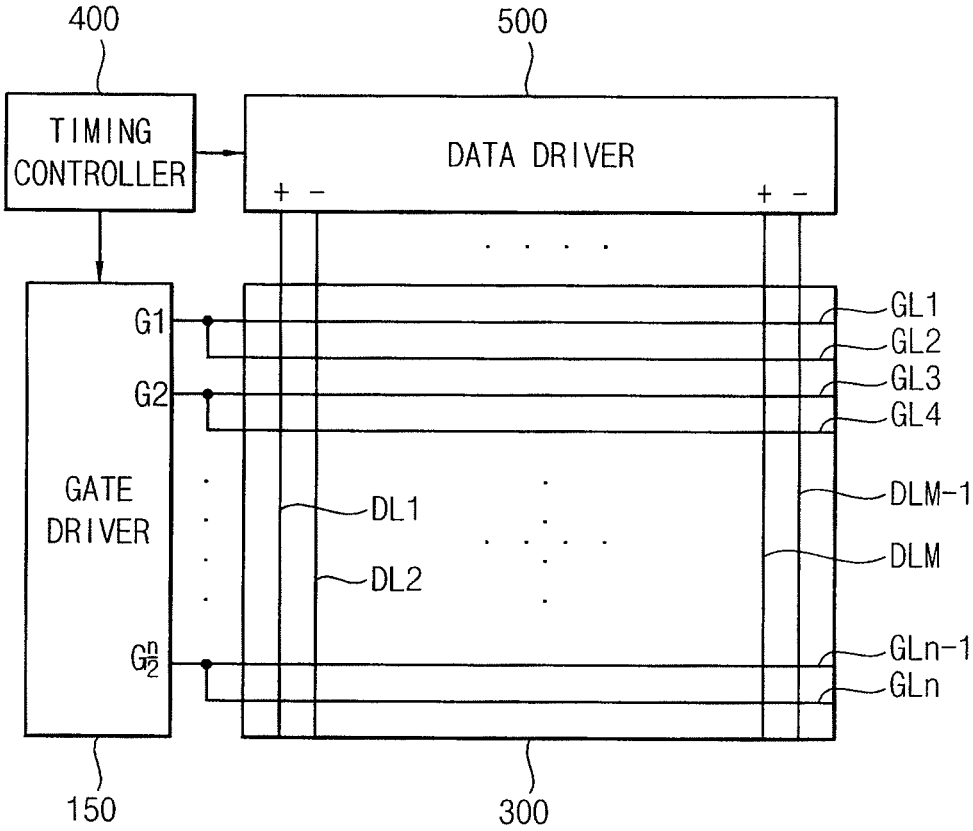
FIG. 3 is a block diagram of the display apparatus of FIG. 1 according to an exemplary embodiment of the present invention.
Figure 4:
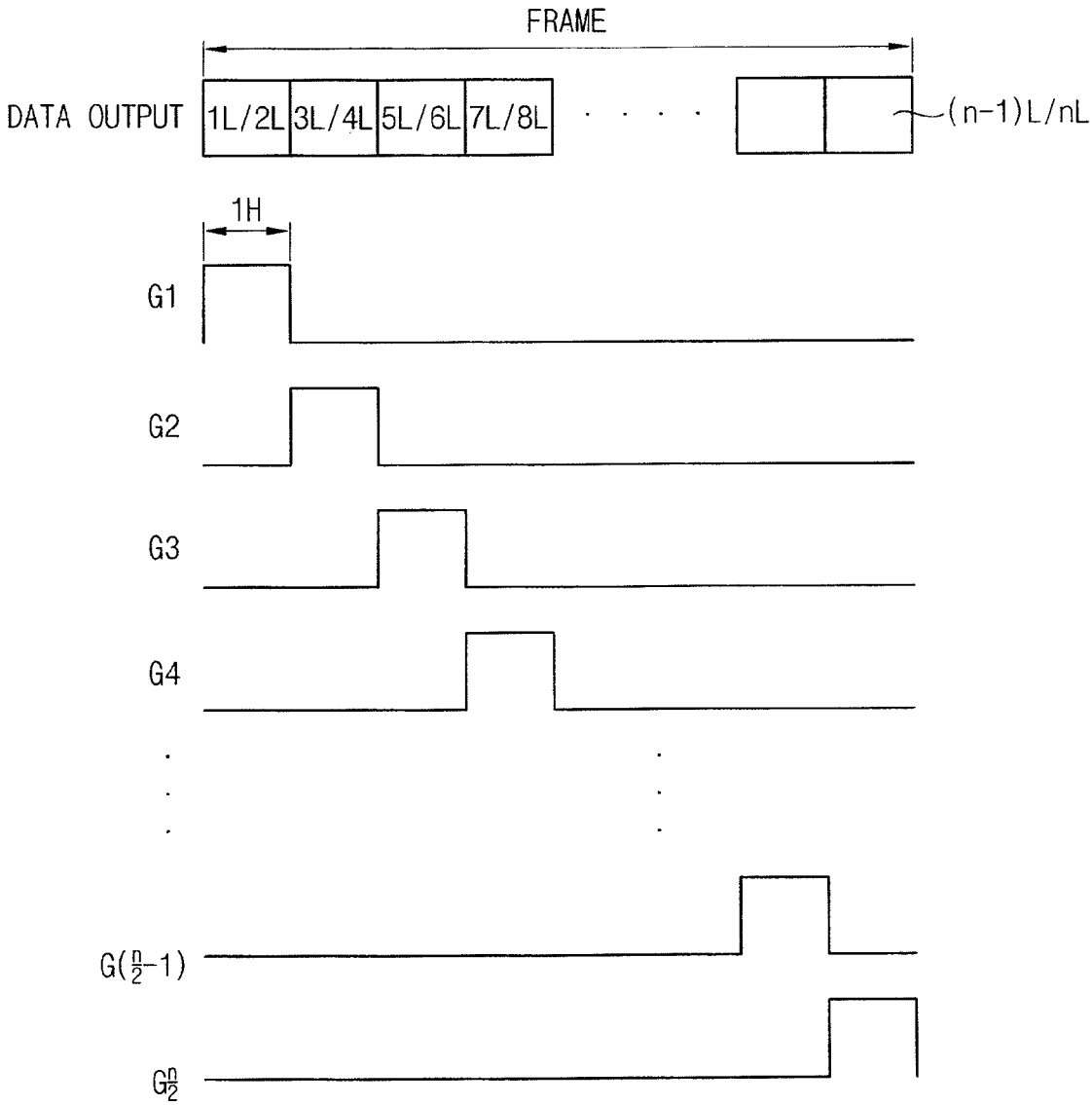
FIG. 4 is a waveform diagram illustrating a method of driving the display apparatus of FIG. 3 according to an exemplary embodiment of the present invention.

FIG. 3 is a block diagram illustrating the display apparatus of FIG. 1 according to an exemplary embodiment of the present invention. FIG. 4 is a waveform diagram illustrating a method of driving the display apparatus of FIG. 3 according to an exemplary embodiment of the present invention.

Referring to FIGS. 3 and 4, the display apparatus includes a display panel 300, a timing controller 400, a data driver 500, and a gate driver 150.

As shown in FIG. 2, the display panel 300 includes pixel structures in which pixels in a single pixel column are alternately connected to two adjacent data lines, and in which two gate lines connected to pixels in two pixel columns are electrically connected to each other. For example, a display panel 300 having a resolution of m×n will have m×n×C pixels (wherein n is the number of gate lines and C is the number of color pixels in a unit pixel), and m×C×2 data lines.

The timing controller 400 provides data signals to the data driver 500. The timing controller 400 repeatedly provides data corresponding to two horizontal lines to the data driver 500. The two horizontal lines are synchronized with a horizontally synchronized signal and a dot clock signal. For example, the timing controller 400 provides the data corresponding to the pixels in two pixel rows to the data driver 500.

The timing controller 400 provides a gate driving signal to the gate driver 150. The gate driving signal may include, for example, a clock signal and a vertically synchronized signal.

The data driver 500 converts the data corresponding to two horizontal lines received from the timing controller 400 during a horizontal cycle 1H into an analog data voltage. The analog data voltage is output to the M data lines DL1, DL2, . . . , DLM−1, and DLM. Two adjacent data lines are disposed between pixel columns, and data voltages having opposite polarities are applied to each of the two adjacent data lines. The data driver 500 may invert and output the polarities of the data voltages and apply the inverted data voltages to adjacent data lines during consecutive frames. For example, data line DL2 may have a negative polarity and data line DL3 may have a positive polarity during a first frame, and data line DL2 may have a positive polarity and data line DL3 may have a negative polarity in a second, subsequent frame.

The gate driver 150 generates n/2 gate signals and outputs the gate signals to n gate lines. A single gate signal may be simultaneously provided to two gate lines. For example, when two gate lines are electrically connected to each other, the gate driver 150 may simultaneously provide a single gate signal to the two gate lines. Alternatively, when the two gate lines are not connected to each other, the gate driver 150 may separately provide equivalent gate signals to each of the gate lines. Thus, each of the gate signals provided by the gate driver 150 turns on switching elements electrically connected to the gate lines.

Referring to FIG. 4, a method of driving the display panel 300 is illustrated according to an exemplary embodiment of the present invention.

The data driver 500 converts data 1L/2L corresponding to a first horizontal line (e.g., a first pixel row) and a second horizontal line (e.g., a second pixel row) into data voltages, and outputs the data voltages to the M data lines DL1, DL2, . . . , DLM−1, DLM. The gate driver 150 then generates a first gate signal G1 having a pulse width corresponding to 1H, and outputs the first gate signal G1 to first and second gate lines GL1 and GL2. The pixels in the first and second pixel rows are then charged based on data 1L/2L.

The data driver 500 then converts data 3L/4L corresponding to a third horizontal line (e.g., a third pixel row) and a fourth horizontal line (e.g., a fourth pixel row) into data voltages, and outputs the data voltages to the M data lines DL1, DL2, . . . , DLM−1, and DLM. The gate driver 150 then generates a second gate signal G2 having a pulse width corresponding to 1H, and outputs the second gate signal G2 to third and fourth gate lines GL3 and GL4. The pixels in the third and fourth pixel rows are then charged based on data 3L/4L.

The data driver 500 then converts data (n−1)L/nL corresponding to an (n−1)-th horizontal line (e.g., an (n−1)-th pixel row) and an n-th horizontal line (e.g., an n-th pixel row) into data voltages, and outputs the data voltages to the M data lines DL1, DL2, . . . , DLM−1, DLM. The gate driver 150 then generates an (n/2)-th gate signal Gn/2 having a pulse width corresponding to 1H, and outputs the (n/2)-th gate signal Gn/2 to (n−1)-th and n-th gate lines GLn−1 and GLn. As a result, a frame cycle during which an image of a frame is displayed on the display panel 300 by the data driver 500 and the gate driver 150 may be about (n/2)×1H.

Figure 5:
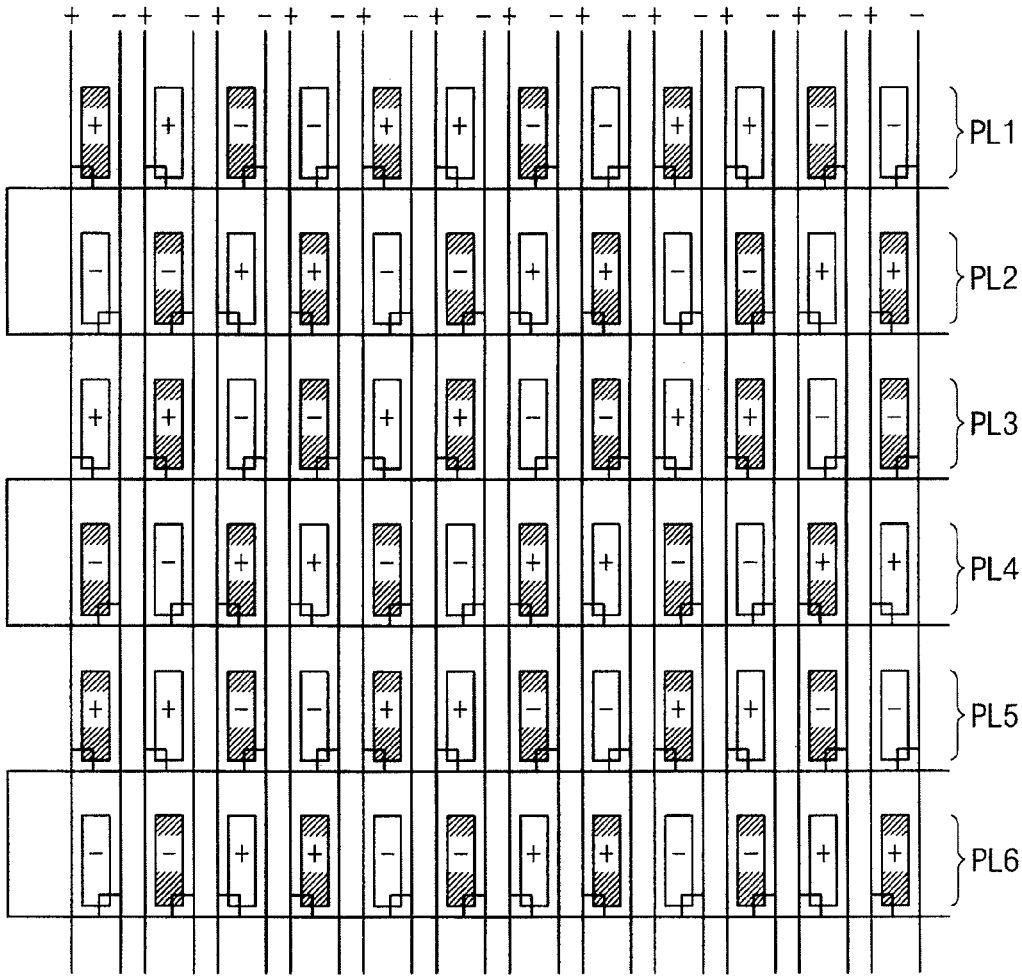
FIG. 5 is a diagram of the display panel of FIG. 2 on which a test pattern is displayed according to an exemplary embodiment of the present invention.

FIG. 5 is a diagram of the display panel of FIG. 2 on which a test pattern is displayed according to an exemplary embodiment of the present invention.

Referring to FIG. 5, the data driver 500 and the gate driver 150 display the (2+1) test pattern on the display panel 300 in response to the timing controller 400.

Odd-numbered pixels in the first pixel row PL1 of the display panel 300 display a black image, and even-numbered pixels in the first pixel row PL1 display a color image. Odd-numbered pixels in the second and third pixel rows PL2 and PL3 display the color image, and even-numbered pixels in the second and third pixel rows PL2 and PL3 display the black image. Odd-numbered pixels in the fourth and fifth pixel rows PL4 and PL5 display the black image, and even-numbered pixels in the fourth and fifth pixel rows PL4 and PL5 display the color image. As explained above, the pixels in the pixel rows PL2, PL3, PL4, and PL5 alternately display the black image and the color image every two pixel rows. As a result, the (2+1) test pattern is displayed.

As shown in FIG. 5, according to the pixel structures of the present exemplary embodiment, the polarities of the pixels displaying the color image in two adjacent pixel rows (e.g., pixel rows PL1 and PL2, pixel rows PL3 and PL4, and pixel rows PL5 and PL6) are uniformly distributed among pixels having the first polarity (+) and the second polarity (−). Similarly, the polarities of the pixels displaying the black image in two adjacent pixel rows are uniformly distributed among pixels having the first polarity (+) and the second polarity (−). As a result of the polarities of the pixels displaying the color image being uniformly distributed, distortion of the common voltage caused by the inversion driving may be decreased. Thus, image distortion such as, for example, non-uniform luminance distribution and cross talk may be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display apparatus comprising:

a first pixel comprising a first pixel electrode electrically connected to a first data line and a first gate line through a first switching element;

a second pixel comprising a second pixel electrode electrically connected to a second data line and a second gate line through a second switching element;

a third pixel comprising a third pixel electrode electrically connected to a third data line and the first gate line through a third switching element, wherein the second and third data lines are adjacent to each other and disposed between the first and third pixels;

a fourth pixel comprising a fourth pixel electrode electrically connected to a fourth data line and the second gate line through a fourth switching element;

a fifth pixel comprising a fifth pixel electrode electrically connected to a fifth data line and the second gate line through a fifth switching element, wherein the fourth and fifth data lines are adjacent to each other and disposed between the fourth and fifth pixels;

a sixth pixel comprising a sixth pixel electrode electrically connected to a sixth data line and the first gate line through a sixth switching element;

a seventh pixel comprising a seventh pixel electrode electrically connected to a seventh data line and the second gate line through a seventh switching element, wherein the sixth and seventh data lines are adjacent to each other and disposed between the fifth and seventh pixels; and an eighth pixel comprising an eighth pixel electrode electrically connected to an eighth data line and the first gate line through an eighth switching element, wherein at least two pixels of the first to eighth pixels display black images, polarities of the pixels displaying the black images alternate in a first direction parallel with the first to eighth data lines and a second direction parallel with the first and second gate lines, and all adjacent pixels among the pixels displaying the black images in each of first and second pixel rows have opposite polarities.

2. The display apparatus of claim 1, further comprising a common electrode opposing the first through eighth pixel electrodes, wherein a common voltage is applied to the common electrode.

3. The display apparatus of claim 2, further comprising a data driver configured to apply voltages having opposite polarities to adjacent data lines.

4. The display apparatus of claim 3, wherein the data driver is configured to invert the polarities of the voltages applied to the adjacent data lines during consecutive frames.

5. The display apparatus of claim 1, wherein the first gate line and the second gate line are electrically connected to each other.

6. The display apparatus of claim 1, further comprising a gate driver configured to apply a same gate signal to the first gate line and the second gate line.

7. The display apparatus of claim 1, wherein:

the first, third, sixth, and eighth pixels are arranged in a direction substantially parallel to the first gate line, and are disposed on a first side of the first gate line; and the second, fourth, fifth, and seventh pixels are arranged in a direction substantially parallel to the second gate line, are disposed on a second side of the first gate line, opposing the first side, and are disposed between the first and second gate lines.

8. The display apparatus of claim 7, wherein:

the first and second pixels are disposed between the first and second data lines, and are arranged in a direction substantially parallel to the first and second data lines;

the third and fourth pixels are disposed between the third and fourth data lines, and are arranged in a direction substantially parallel to the third and fourth data lines;

the fifth and sixth pixels are disposed between the fifth and sixth data lines, and are arranged in a direction substantially parallel to the fifth and sixth data lines; and the seventh and eighth pixels are disposed between the seventh and eighth data lines, and are arranged in a direction substantially parallel to the seventh and eighth data lines.

9. The display apparatus of claim 8, wherein the first, third, fifth and seventh pixels are configured to apply a first polarity data, and the second, fourth, sixth and eight pixels are configured to apply a second polarity data different from the first polarity data.

10. The display apparatus of claim 1, wherein:

the second, third, fifth, and eighth pixels display color images; and the first, fourth, sixth, and seventh pixels display the black images.

11. A method of driving a display panel, the method comprising:

applying data voltages to a first ,second, third, fourth, fifth, sixth, seventh, and eighth data line of the display panel, wherein the display panel comprises:

a first pixel comprising a first pixel electrode electrically connected to the first data line and a first gate line, a second pixel comprising a second pixel electrode electrically connected to the second data line and a second gate line, a third pixel comprising a third pixel electrode electrically connected to the third data line and the first gate line, wherein the second and third data lines are adjacent to each other and disposed between the first and third pixels, a fourth pixel comprising a fourth pixel electrode electrically connected to the fourth data line and the second gate line, a fifth pixel comprising a fifth pixel electrode electrically connected to the fifth data line and the second gate line, wherein the fourth and fifth data lines are adjacent to each other and disposed between the fourth and fifth pixels, a sixth pixel comprising a sixth pixel electrode electrically connected to the sixth data line and the first gate line, a seventh pixel comprising a seventh pixel electrode electrically connected to the seventh data line and the second gate line, wherein the sixth and seventh data lines are adjacent to each other and disposed between the fifth and seventh pixels, and an eighth pixel comprising an eighth pixel electrode electrically connected to the eighth data line and the first gate line; and applying a same gate signal to the first and second gate lines, wherein at least two pixels of the first to eighth pixels display black images, polarities of the pixels displaying the black images alternate in a first direction parallel with the first to eighth data lines and a second direction parallel with the first and second gate lines, and all adjacent pixels among the pixels displaying the black images in each of first and second pixel rows have opposite polarities.

12. The method of claim 11, further comprising applying a common voltage to a common electrode, wherein the common electrode opposes the first through eighth pixel electrodes.

13. The method of claim 12, wherein applying the data voltages comprises applying data voltages having opposite polarities to adjacent data lines.

14. The method of claim 13, wherein applying the data voltages to the adjacent data lines comprises inverting the polarities of the data voltages during consecutive frames.

15. The method of claim 11, wherein:

the first, third, sixth, and eighth pixels are arranged in a direction substantially parallel to the first gate line, and are disposed on a first side of the first gate line; and the second, fourth, fifth, and seventh pixels are arranged in a direction substantially parallel to the second gate line, are disposed on a second side of the first gate line, opposing the first side, and are disposed between the first and second gate lines.

16. The method of claim 15, wherein:

the first and second pixels are disposed between the first and second data lines, and are arranged in a direction substantially parallel to the first and second data lines;

the third and fourth pixels are disposed between the third and fourth data lines, and are arranged in a direction substantially parallel to the third and fourth data lines;

the fifth and sixth pixels are disposed between the fifth and sixth data lines, and are arranged in a direction substantially parallel to the fifth and sixth data lines; and the seventh and eighth pixels are disposed between the seventh and eighth data lines, and are arranged in a direction substantially parallel to the seventh and eighth data lines.

17. The method of claim 11, wherein:

color images are displayed by the second, third, fifth, and eighth pixels; and the black images are displayed by the first, fourth, sixth, and seventh pixels.

18. A method of driving a display panel, the method comprising:

applying a first gate signal to a first pixel row and a second pixel row disposed adjacent to the first pixel row simultaneously, wherein a first pixel in the first pixel row and a first pixel in the second pixel row are configured to be charged with data voltages having opposite polarities, and a second pixel in the first pixel row and a second pixel in the second pixel row are configured to be charged with data voltages having opposite polarities;

applying two voltages having opposite polarities to two adjacent data lines, wherein the two adjacent data lines are disposed between two adjacent pixels; and inverting the polarities of the two applied voltages during consecutive frames, wherein at least two pixels of the first pixel row and the second pixel row display black images, polarities of the pixels displaying the black images alternate in a first direction parallel with the first to eighth data lines and a second direction parallel with the first and second gate lines, and all adjacent pixels among the pixels displaying the black images in each of the first and second pixel rows have opposite polarities.

19. The method of claim 18, further comprising:

applying a second gate signal to a third pixel row and a fourth pixel row disposed adjacent to the third pixel row simultaneously, wherein a first pixel in the third pixel row and a first pixel in the fourth pixel row are configured to be charged with data voltages having opposite polarities, and a second pixel in the third pixel row and a second pixel in the fourth pixel row are configured to be charged with data voltages having opposite polarities;

wherein the first pixel in the second pixel row and the first pixel in the third pixel row are configured to apply opposite polarities.

20. The method of claim 19, further comprising:

applying data voltages having same polarity to the first pixel and the second pixel in the first pixel row, and applying a data voltage to a third pixel in the first pixel row, which is disposed adjacent to the second pixel in the first pixel row, wherein the data voltage charged to the third pixel in the first pixel row has an opposite polarity to the data voltage charged to the second pixel in the first pixel row.

* * * * *